United States Patent [19]

Donnell

[11] Patent Number: 4,971,192

[45] Date of Patent: Nov. 20, 1990

[54] COIN HOLDING DEVICE

[76] Inventor: Robert T. Donnell, 1050 First Ave., Sweet Home, Oreg. 97386

[21] Appl. No.: 420,444

[22] Filed: Oct. 12, 1989

[51] Int. Cl.[5] ..... B65D 25/10; B65D 85/00

[52] U.S. Cl. ..... 206/0.82; 206/477; 248/216.1

[58] Field of Search ..... 248/216.1; 206/0.82, 206/0.81, 0.8, 303, 445, 477, 480, 483

[56] References Cited

U.S. PATENT DOCUMENTS

| | | | |
|---|---|---|---|
| 417,016 | 12/1889 | Gaynor | 206/0.82 X |
| 1,053,704 | 2/1913 | Broadberry | 206/0.82 |
| 2,083,117 | 6/1937 | Cunningham | 206/0.82 |
| 2,221,801 | 11/1940 | Keppinger | 248/216.1 |
| 2,358,262 | 9/1944 | Suess | 206/0.81 |
| 3,420,359 | 1/1969 | Cochrane | 206/0.82 |
| 3,776,643 | 12/1973 | Titoff | 206/0.8 X |
| 3,788,464 | 1/1974 | Skinner | 206/0.82 |
| 3,837,475 | 9/1974 | Bolanz | 206/0.82 X |
| 4,091,639 | 5/1978 | Benda | 63/18 |
| 4,165,573 | 8/1979 | Richards | 40/10 D |
| 4,378,876 | 4/1983 | Szabo et al. | 206/0.82 X |

FOREIGN PATENT DOCUMENTS

| | | | |
|---|---|---|---|
| 219173 | 1/1958 | Australia | 206/0.8 |

*Primary Examiner*—Paul T. Sewell
*Assistant Examiner*—Jacob K. Ackun, Jr.
*Attorney, Agent, or Firm*—Henderson & Sturm

[57] ABSTRACT

A coin holding device (10) for holding coins (100) having different diameters wherein the device includes a generally flexible base unit (11) having an open framework member (14) provided with a plurality of catch members (20) on one side and a plurality of prong units (13) on the other side; wherein, the framework member (14) is further provided with hinge elements (16) and spring members (17) so that the framework member (14) may be flexed outwardly to accomodate coins having different diameters.

7 Claims, 1 Drawing Sheet

COIN HOLDING DEVICE

TECHNICAL FIELD

This invention relates to money holders in general, and more particularly to a coin holder for the purpose of displaying coins.

BACKGROUND OF THE INVENTION

As can be seen by reference to the following U.S. Pat. Nos.: 3,420,359; 3,788,464; 4,091,639 and 4,165,573 the prior art is replete with myriad and diverse coin holders which are adapted to hold and display coins and like objects.

While the prior art constructions are more than adequate for the purpose and function for which they were specifically designed, they do suffer from a number of shared deficiencies.

As most coin collectors are well aware, there is a need for a coin holder device that can be used to display a coin collection and be adjustable so as to adapt to different sized coin diameters. This is one particular area where the prior art constructions fall far short of their intended mark.

U.S. Pat. Nos.: 3,788,464; 4,165,573 and 4,091,639 address the problem of displaying a single coin, but do not address the problem of displaying a coin collection as a whole.

In addition, U.S. Pat. No. 3,420,359 solves the problem of handling a large amount of coins but does so in a fashion which makes it impossible to view the coins on an individual basis while contained within the device.

Another shortcoming of the prior art patented devices is the inability of these constructions to hold the coin firmly in a such a manner that the coin is not able to slide back and forth either within the device or against other coins which could damage the coins and reduce their value.

Another method of displaying coins not mentioned thus far is through the use of coin albums; but, the main problem with a coin album is that they do not allow the viewer to look at the coin collection as a whole.

Given the present enormous number of commemorative and rare coins being collected, there is a pressing need for a coin holder that will be able to adjust to many different sized coins, and also be able to display these coins in a manner so that the collection can be viewed as a whole; and, the provision of such a device is a stated objective of the present invention.

SUMMARY OF THE INVENTION

An object of the present invention is to provide a coin holder which can be used to display coins.

Another object of this invention is the use of a spring type holding device that will accommodate different sized coins.

Still another object of this present invention is to have a plurality of catches attached to the coin holding device to securely retain the coins within the coin holder.

A further object of the invention is the provision of pins on the back of the coin holding device which would enable the coin holder to be mounted on a soft board.

Yet another object of the present invention is to enable the user to display a coin collection by deploying a plurality of the coin holders on certain types of substrates.

BRIEF DESCRIPTION OF THE DRAWING

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
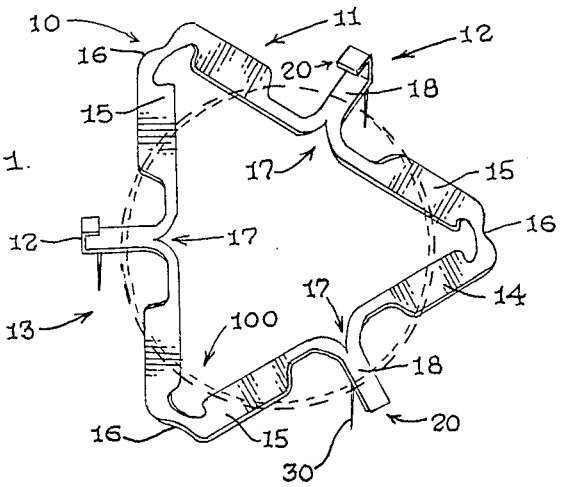
FIG. 1 is a perspective view of the coin holding device of this invention.

As can be seen by reference to the drawings and in particular to FIG. 1, the coin holding device that forms the basis of the present invention is designated generally by the reference numeral (10). The coin holding device (10) comprises a generally flexible base unit (11); a plurality of catch units (12); and a plurality of prong units (13). These units will now be described in seriatim fashion.

Figure 3:
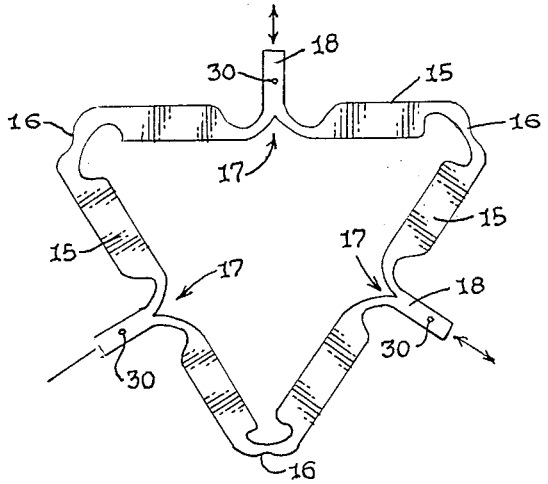
FIG. 3 a bottom plan view of the device.

As shown in FIGS. 1 and 3, the base unit (11) includes a generally triangular open framework member (14) comprising three integrally connected and contoured arm elements (15). Each of the arm elements (15) has a reduced dimension portion formed on each end proximate the juncture of each arm element (15) with the other arm element (15); and, this reduced dimension portion serves as a flexible hinge connector (16) for the triangular framework member (14). In addition, the intermediate portion of each of the arm elements (15) are further provided with a bifurcated reduced diameter spring member (17) which merge into an outwardly projecting tab member (18) whose purpose and function will be described presently.

Figure 2:
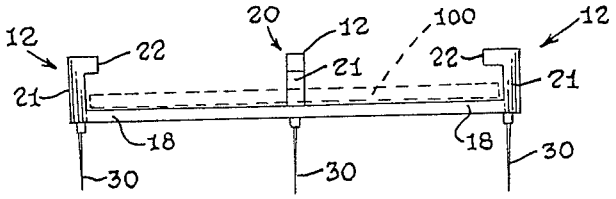
FIG. 2 is a side plan view of the device.

As can best be appreciated by reference to FIGS. 1 and 2, the catch units (12) comprise a plurality of inverted L-shaped catch members (20) having a vertical segment (21) formed on one end to the outboard end of the tab members (18) of the base unit (11) and having a horizontal segment (22) formed on the other end of the vertical segment (21); wherein, the horizontal segment (22) projects inwardly relative to the base unit.

Turning now to FIGS. 2 thru 3, it can be seen that the prong units (13) comprise a plurality of pin members (30) which are provided on the bottom of each of the tab members (18) of the base unit (11); wherein, the pin members (30) are disposed at a location proximate to, but spaced from, the outboard end of the respective tab members (18).

As can best be appreciated by reference to FIGS. 1 thru 3, when a user wishes to insert a coin (100) into the coin holding device (10) all that is necessary is for the edge of the coin (100) to come into contact with one of the catch units (12) on the base unit (11); then the open triangular framework is flexed outwardly relative to the remaining edges of the coin through the combined action of the hinge elements (16) and the spring members (17) to allow the remaining catch units (12) to pass over the edges of the coin (100) to captively engage the coin (100) at spaced locations around its periphery by virtue of the plastic memory of the base unit (11).

In addition, should it be desirous to display either an individual or a collection of coins (100) all that would be necessary would be to choose a penetratable substrate (not shown) such as corkboard, fiber board or the like, such that the pins (30) on the bottom of the base unit (11) will penetratingly engage the substrate to hold the coins in a stationary relationship relative to the substrate.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A coin holding device for coins having different diameters wherein the device comprises:

a base unit including an open framework member having hinge connectors and spring elements formed integrally with the framework member; wherein, each of the said hinge connectors comprise reduced dimension portions formed on the opposed ends of the respective arm elements at the juncture of each of the arm elements; and, wherein the open framework member has a generally triangular configuration and comprises a plurality of arm elements which are joined together on their respective ends; and, a plurality of catch units operatively associated with the base unit and including a plurality of generally inverted L-shaped catch members formed integrally with the open framework member.

2. The device as in claim 1 wherein each of the spring elements comprise a reduced dimension bifurcated portion formed intermediate the ends of each arm element.

3. The device as in claim 2 wherein the said reduced dimension bifurcated portions terminate in an outwardly projecting tab member.

4. The device as in claim 3 wherein the catch members are disposed on the outboard ends of said tab member.

5. The device as in claim 1 further comprising:

a plurality of prong units operatively attached to the bottom of the basic unit.

6. The device as in claim 4 further comprising:

a plurality of prong units operatively attached to the bottom of the base unit.

7. The device as in claim 6 wherein each of the prong units comprise:

a pin member disposed proximate to, but spaced from the outboard end of the respective tab members.

* * * * *